US009425565B1

(12) United States Patent
Chien et al.

(10) Patent No.: US 9,425,565 B1
(45) Date of Patent: Aug. 23, 2016

(54) STRUCTURE OF ELECTRICAL CONNECTOR

(71) Applicant: KINNEXA, INC., Taipei (TW)

(72) Inventors: Shin-Hao Chien, Taipei (TW); John Patrick Quinlan, Taipei (TW)

(73) Assignee: KINNEXA, INC., Taipei (TW)

( * ) Notice: Subject to any disclaimer, the term of this patent is extended or adjusted under 35 U.S.C. 154(b) by 0 days.

(21) Appl. No.: 14/828,525

(22) Filed: Aug. 18, 2015

(30) Foreign Application Priority Data

Apr. 30, 2015 (TW) ..... 104206618 U

(51) Int. Cl.
*H01R 24/60* (2011.01)
*H01R 13/66* (2006.01)
*H01R 107/00* (2006.01)

(52) U.S. Cl.
CPC ..... *H01R 24/60* (2013.01); *H01R 13/665* (2013.01); *H01R 2107/00* (2013.01)

(58) Field of Classification Search
USPC ..... 439/620.22, 569, 660, 358; 385/93, 147
See application file for complete search history.

(56) References Cited

U.S. PATENT DOCUMENTS 6,056,578 A * 5/2000 Lin ..... H01R 13/514 439/358
6,322,387 B2 * 11/2001 Kawamae ..... 439/358
6,799,986 B2 * 10/2004 Igarashi ..... H01R 13/6275 439/358
7,892,015 B2 * 2/2011 Li ..... H01R 13/6275 439/358
8,408,932 B2 * 4/2013 Villarreal ..... H01R 13/6275 439/358
8,708,580 B2 * 4/2014 Wu ..... G02B 6/3817 385/147
9,178,310 B2 * 11/2015 Tsai ..... H01R 13/6315
9,231,356 B1 * 1/2016 Ju ..... H01R 24/78
9,318,856 B2 * 4/2016 MacDougall ..... H01R 13/6581
2005/0186830 A1 * 8/2005 Wu ..... H01R 13/6275 439/358
2006/0019526 A1 * 1/2006 Jeon ..... H01R 13/627 439/358
2006/0121783 A1 * 6/2006 Wu ..... H01R 9/032 439/607.41
2010/0233907 A1 * 9/2010 Wu ..... H01R 9/03 439/607.58
2013/0115823 A1 * 5/2013 Wu ..... H01R 13/6471 439/660
2013/0130549 A1 * 5/2013 Wu ..... H01R 13/6598 439/607.01
2015/0087184 A1 * 3/2015 Fang ..... H01R 13/6471 439/569

* cited by examiner

*Primary Examiner* — Alexander Gilman
(74) *Attorney, Agent, or Firm* — Leong C. Lei

(57) ABSTRACT

An electrical connector includes a hook-up pin mounted on one lateral side of the electrical connector. The hook-up pin includes a pin body, soldering sections respectively formed on two sides of an end of the pin body, an elastic pressing section formed on an end of the pin body that is adjacent to the soldering sections, and a hook section formed on an end of the elastic pressing section that is distant from the soldering sections. The soldering sections are arranged to clamp and be soldered to opposite sides of the circuit substrate. In inserting male and female parts of the present invention to each other, the soldering sections clamp on and are soldered to two sides of the circuit substrate so as to be resistant to the force of insertion and removal and be protected against damage. Further, the hook section helps prevent undesired detachment.

10 Claims, 9 Drawing Sheets

STRUCTURE OF ELECTRICAL CONNECTOR

TECHNICAL FIELD OF THE INVENTION

The present invention relates generally to an improved structure of an electrical connector, and more particularly to an improved structure of an electrical connector that improves structural strength for prevention of damage and improves an effect of coupling and fixation for prevention of detachment, while allowing for easy disengagement.

DESCRIPTION OF THE PRIOR ART

The process of time and science and technology bring various sorts of electronic devices that are full of the market. These electronic devices have been long closely involved in our lives. For electrical connection to be established among various electronic devices and for suiting all sorts of needs of use of the electronic devices, a number of different types of connectors are now available. And, all sorts of connectors are under development and researches for new specifications for the purposes of enhancing the performances thereof. For example, high definition multimedia interface (HDMI) has been evolved from HDMI1.1 to HIDI2.0.

As shown in FIG. 1, which is a schematic view showing a conventional device, during manufacture and test of conventional Super MHL, the present inventor became aware that a male part 91 and a female part 92 of a conventional Super MHL device, when mutually inserted to each other, show a very limited capability against a pulling force applied thereto so that they are readily detached.

Thus, it is a challenge of the present inventor and those involved in this business to develop a solution that overcomes the above problems and deficiencies.

SUMMARY OF THE INVENTION

In view of the above drawbacks, through collection of data and assessment and consideration in multiple aspects, in combination with years' experience in the associated business, the present inventor creates, through repeated trivial and modification, an improved structure of an electrical connector that improves structural strength for prevention of damage and improves an effect of coupling and fixation for prevention of detachment, while allowing for easy disengagement.

A primary object of the present invention is to prevent damage caused by a pulling force in insertion and removal.

Another primary object of the present invention is to prevent accidental detachment between mated male and female parts.

A further primary object of the present invention is to allow for easy disengagement of the male and female parts.

To achieve the above object, the present invention comprises at least one hook-up pin mounted on at least one lateral side of an electrical connector. The hook-up pin comprises at least one pin body. A plurality of soldering sections is formed on two sides of an end of the pin body for clamping and being soldered to a circuit substrate. At least one elastic pressing section is formed on an end of the pin body that is adjacent to the soldering sections. At least one hook section is formed on an end of the elastic pressing section that is distant from the soldering sections. When male and female parts of the present invention are inserted into each other, fixation can be achieved with the hook section so as to prevent unexpected detachment caused by factors including accidental impact. To disengage the male and female parts, it only needs to press down the elastic pressing section and easy disengagement can be achieved. Further, since the soldering sections are respectively set on two sides of the circuit substrate, the structural strength is enhanced to resist the force of insertion and removal. With the above-described technique, the problem that the conventional Super MHL suffers easy and unexpected detachment can be overcome and advantages that the structural strength is enhanced to prevent damage and an effect of coupling and fixing is enhanced, while easy disengagement is allowed, can be achieved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
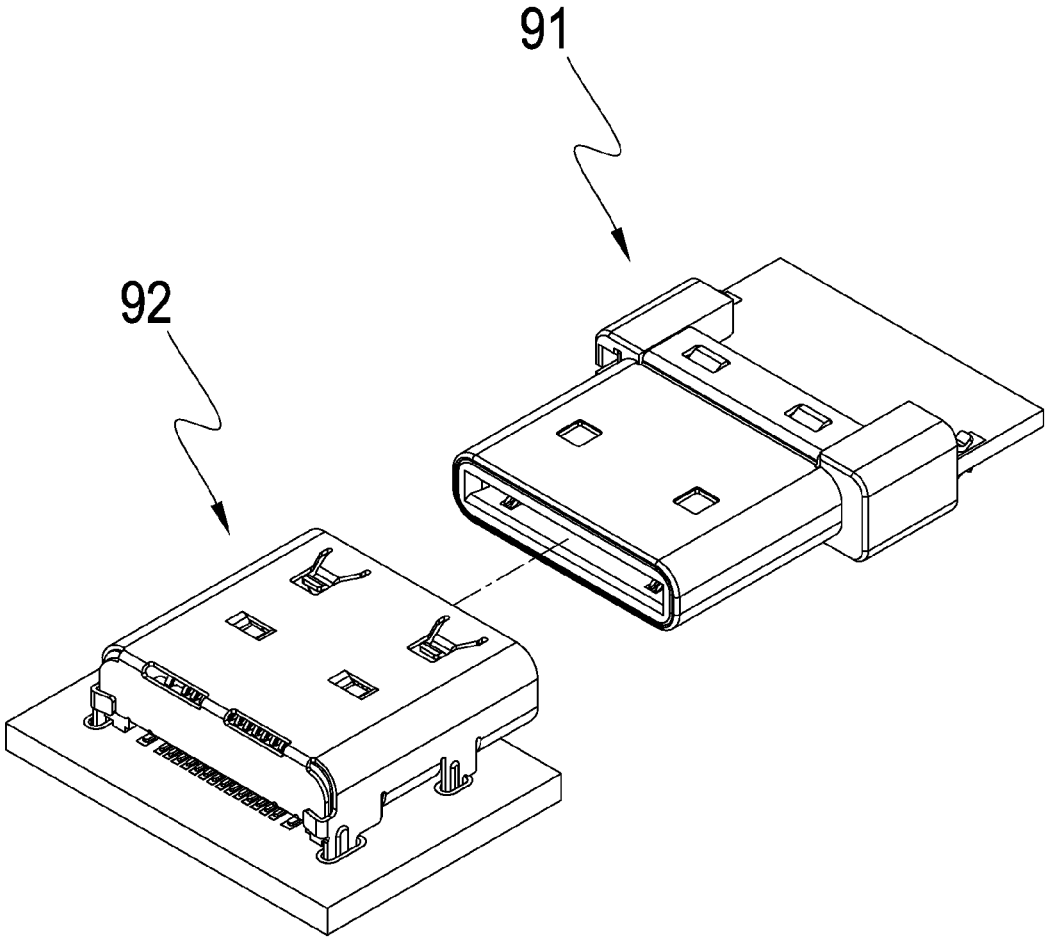
PRIOR ART FIG. 1
FIG. 1 is a perspective view showing a conventional device.
Figure 2:
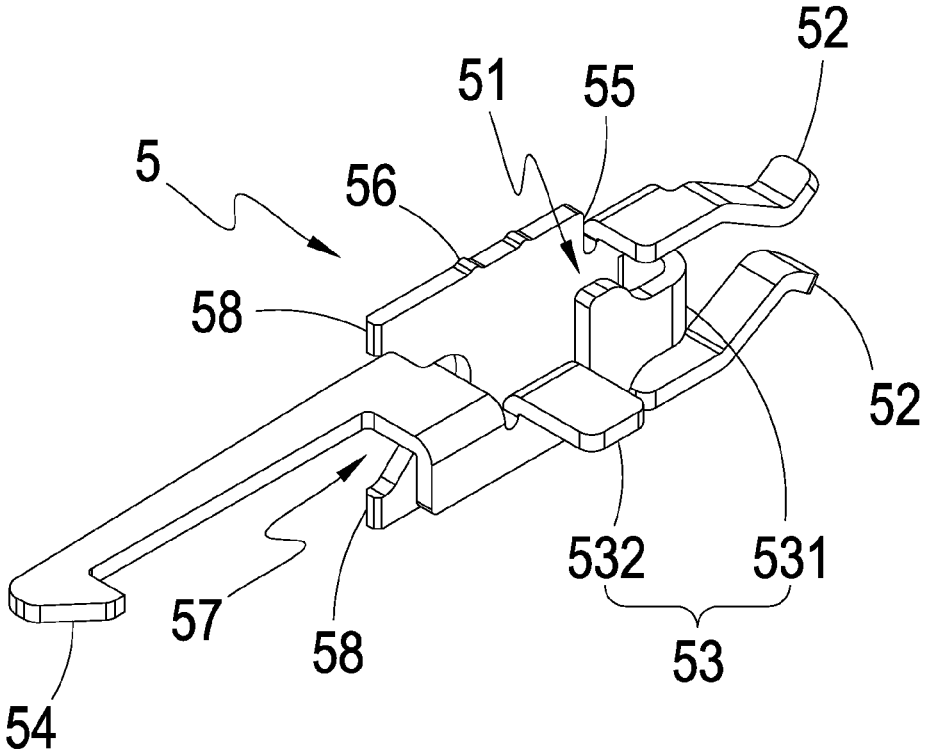
FIG. 2 is a perspective view showing a hook-up pin of a preferred embodiment of the present invention.
Figure 3:
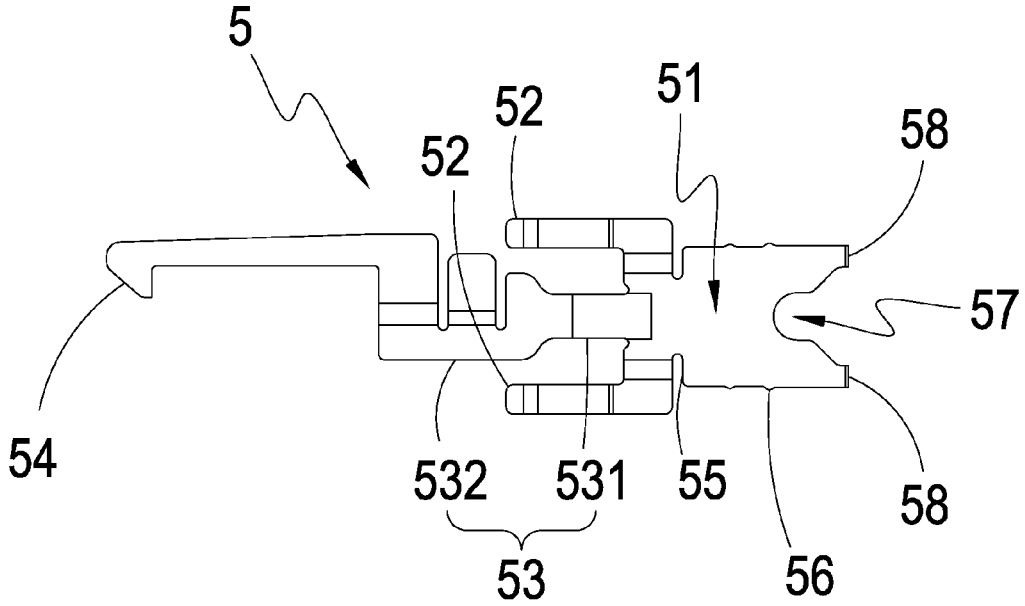
FIG. 3 is a schematic view showing, in a developed form, the hookup pin of the preferred embodiment of the present invention.
Figure 4:
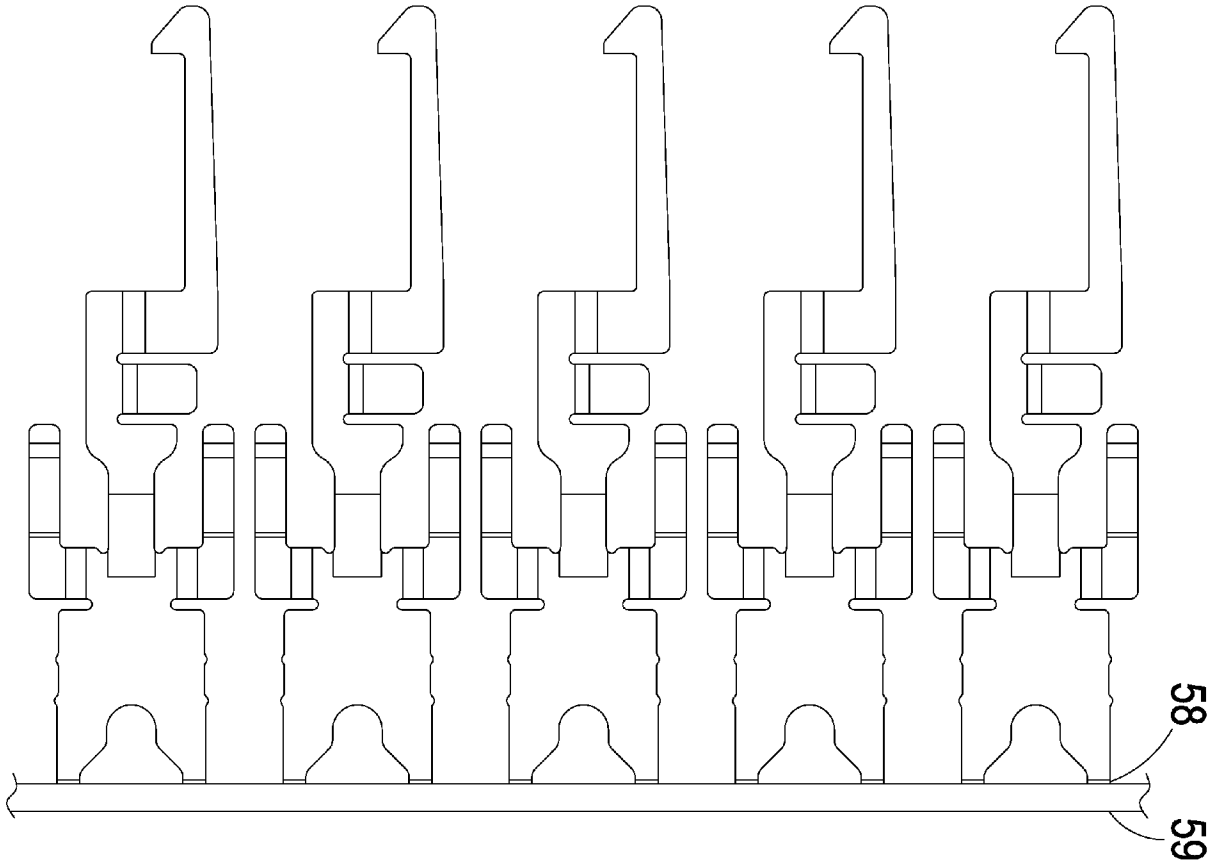
FIG. 4 is a schematic view illustrating formation of the hook-up pin of the preferred embodiment of the present invention.
Figure 5:
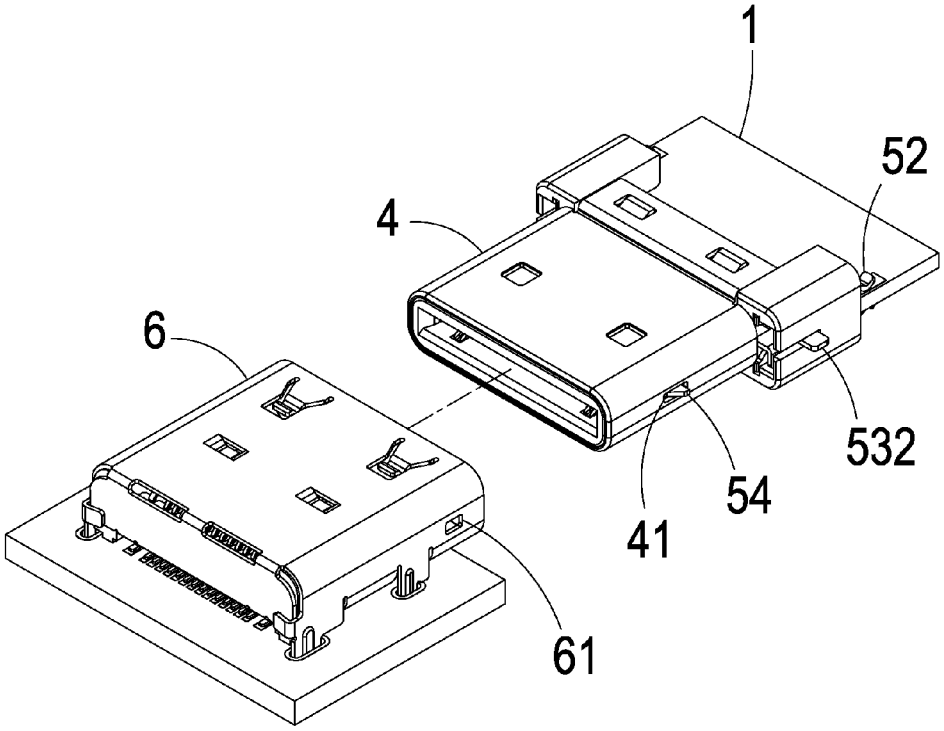
FIG. 5 is a perspective view showing the preferred embodiment of the present invention.
Figure 6:
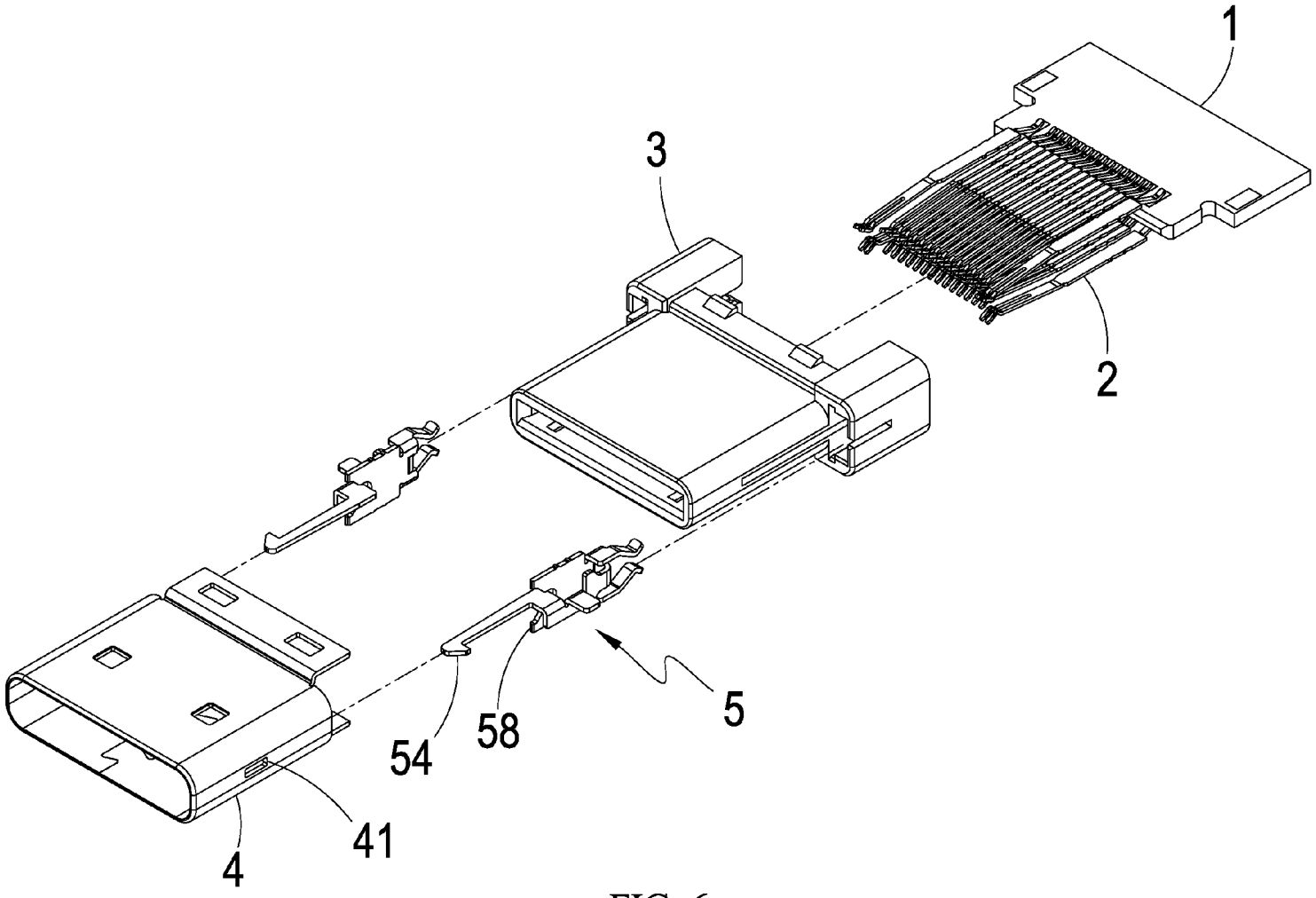
FIG. 6 is a partial exploded view of the preferred embodiment of the present invention.
Figure 7:
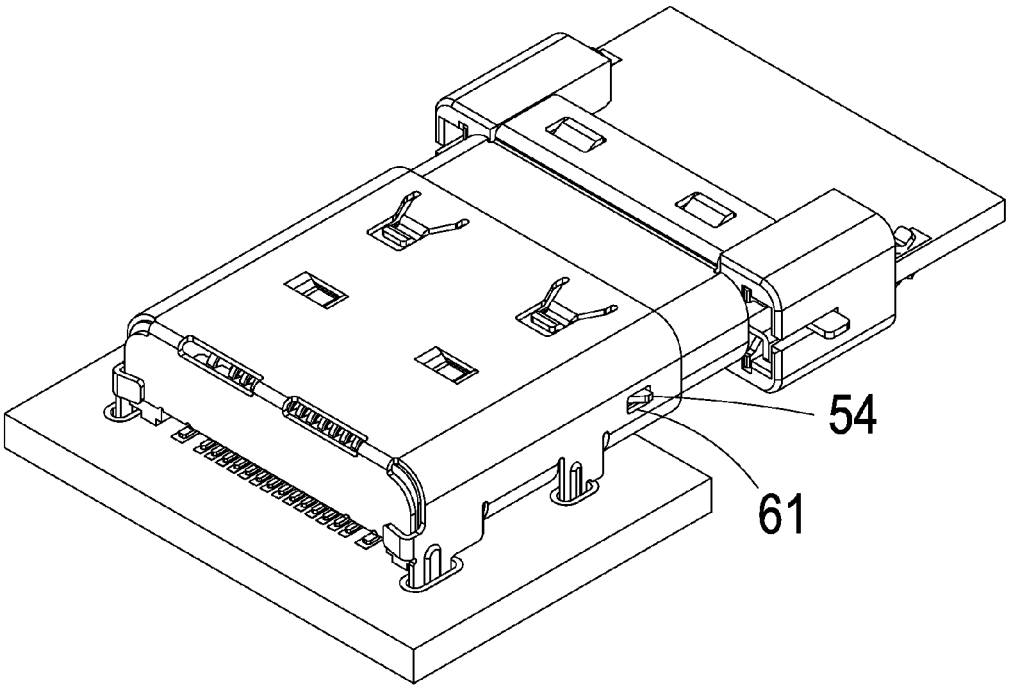
FIG. 7 is a schematic view illustrating the preferred embodiment of the present invention in an inserted and mating condition.
Figure 8:
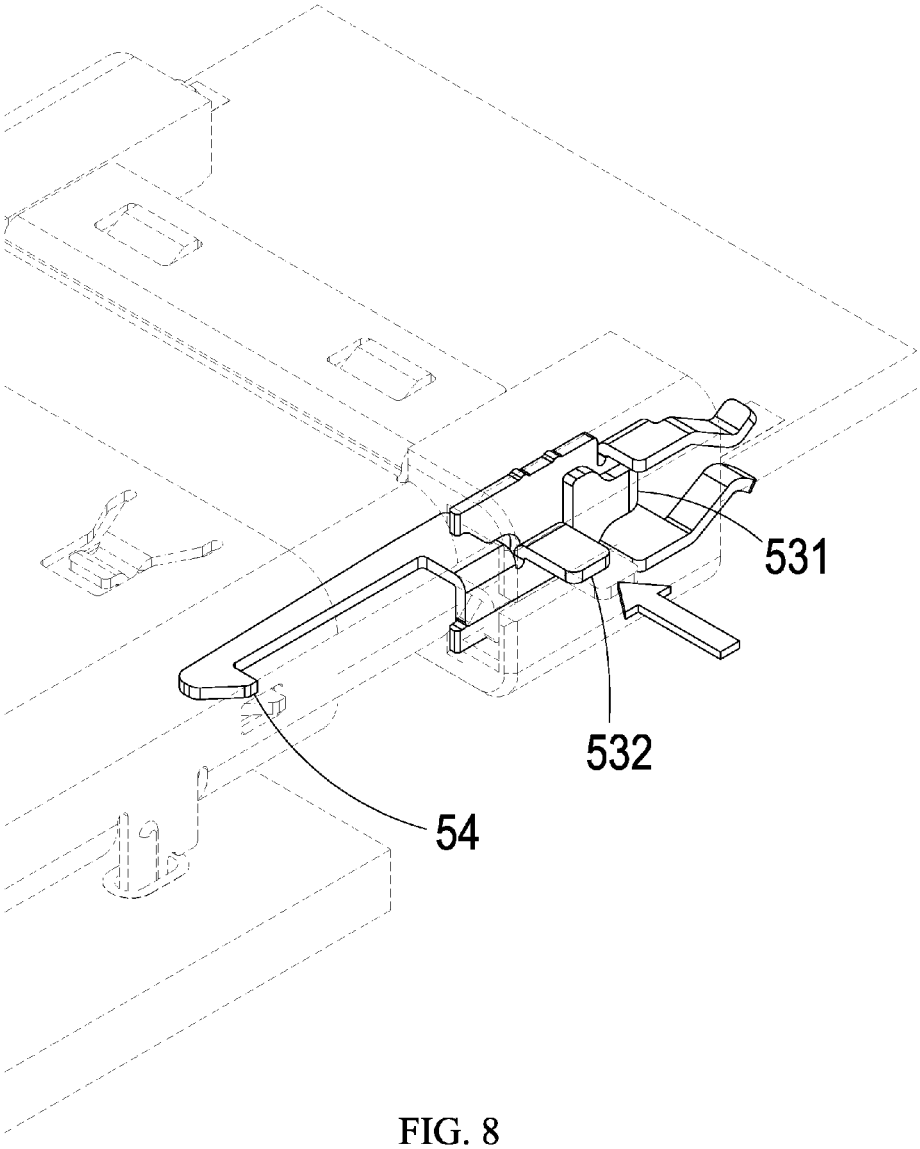
FIG. 8 is a schematic view illustrating disengagement of the preferred embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 2-6, which are respectively a perspective view showing a hook-up pin of a preferred embodiment of the present invention, a schematic view showing, in a developed form, the hookup pin, a schematic view illustrating formation of the hook-up pin, a perspective view showing the preferred embodiment of the present invention, and a partial exploded view of the preferred embodiment of the present invention, these drawings clearly show that the present invention comprises at least one hook-up pin 5 that is integrally formed as a unitary piece. The hook-up pin 5 comprises at least one pin body 51, a plurality of soldering sections 52, at least one elastic pressing section 53, and at least one hook section 54. The pin body 51 is formed on the hook-up pin 5. The soldering sections 52 are respectively formed on two sides of an end of the pin body 51. The elastic pressing section 53 is formed on an end of the pin body 51 that is adjacent to the soldering sections 52. The hook section 54 is formed on an end of the elastic pressing section 53 that is distant from the soldering sections 52. The elastic pressing section 53 comprises at least one elastic section 531 extending from the end of the pin body 51 that is adjacent to the soldering sections 52 and at least one pressing section 532 extending from an end of the elastic section 531 that is distant from the pin body 51. Further, the soldering sections 52, the elastic pressing section 53, or the hook section 54 is of a curved configuration.

At least one constraining section 55 is formed on the end of the pin body 51 that is adjacent to the soldering sections 52. The pin body 51 has a side edge on which at least one retention section 56 is formed. At least one accommodation opening 57 is formed in the end of the pin body 51 that is distant from the soldering sections 52 to receive and accommodate the hook section 54 therein. At least one bearing section 58 is formed on the end of the pin body 51 that are distant from the soldering sections 52. The bearing section 58 is connectable to at least one parts strip 59 to facilitate manufacture.

The electrical connector described in the present invention meets the specification of Super Mobile High-Definition Link (Super MHL) and is composed of a male connector part and a female connector part that corresponds to and is insertable into and thus mateable with the male connector part. The hook-up pin 5 is set on at least one lateral side of the male connector part at least one. The male connector part further comprises at least one circuit substrate 1, a plurality of transmission pins 2, at least one insulation body 3, and at least one metal shell 4. The transmission pins 2 are each soldered to an end of the circuit substrate 1. The insulation body 3 is fit onto the circuit substrate 1 and the transmission pins 2, while the hook-up pin 5 is set through and received in the insulation body 3 in such a way that the elastic pressing section 53 allows the hook section 54 to move and the pressing section 532 penetrates outside the insulation body 3 to be accessible and depressible by a user. The constraining section 55 abuts an internal wall of the insulation body 3 to constrain the position of the hook-up pin 5. The soldering sections 52 project outside the insulation body 3 to allow the soldering sections 52 to clamp and be soldered to opposite sides of the circuit substrate 1. The retention section 56 engages, in a retaining manner, with the insulation body 3 to enhance an effect of retaining and fixing the hook-up pin 5. The metal shell 4 is fit over the insulation body 3 and the hook-up pin 5 and engages and contacts the bearing section 58 to enhance an effect of retaining and fixing the pin body 51. The metal shell 4 has a side wall in which at least one penetration opening 41 is formed for selective penetration of the hook section 54. The female connector part comprises a shielding casing 6, which has a side wall in which at least one holding opening 61 is formed to correspond to the penetration opening 41 for selective hooking engagement by the hook section 54. Further, the above described is only one possible configuration of embodying the present invention, of which other configurations are available and not limited to what described herein.

Referring collectively to FIGS. 2-8, which are respectively a perspective view showing a hook-up pin of a preferred embodiment of the present invention, a schematic view showing, in a developed form, the hookup pin, a schematic view illustrating formation of the hook-up pin, a perspective view showing the preferred embodiment of the present invention, a partial exploded view of the preferred embodiment of the present invention, a schematic view illustrating an inserted and mating condition, and a schematic view illustrating disengagement of the present invention, the drawings clearly show when the male connector part and the female connector part are inserted into and mate with each other, the hook section 54 contacts the female connector part and is temporarily retractable, through the elastic section 531, into the male connector part until reaching the holding opening 61, where the elasticity or spring force of the elastic section 531 springs the hook section 54 through the penetration opening 41 and the holding opening 61 to hook up the holding opening 61 so as to prevent the male connector part and the female connector part from accidentally detaching from each other.

To disengage the male connector part and the female connector part from each other, the pressing section 532 is pressed down so that, through the elastic section 531, the hook section 54 retracts back into the male connector part, allowing easy disengagement of the male connector part and the female connector part from each other.

Figure 9:
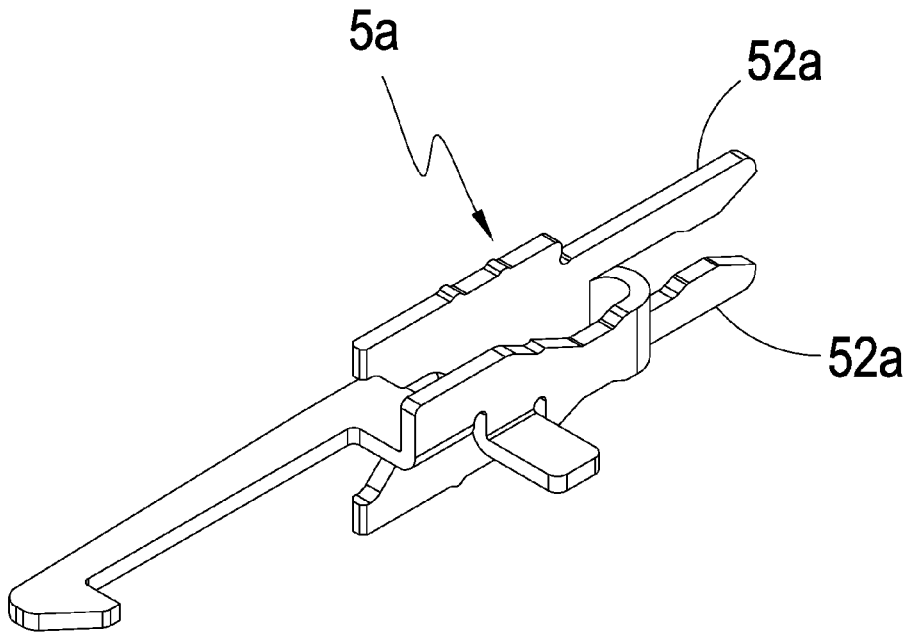
FIG. 9 is a schematic view illustrating a hook-up pin of another preferred embodiment of the present invention.

Referring to FIG. 9, which is a schematic view illustrating a hook-up pin of another preferred embodiment of the present invention, the drawing clearly shows that the instant embodiment is substantially similar to the previous embodiment and a difference resides in that the soldering sections **52*a* of the hook-up pin 5*a*** are each in a linear and straight form. This is provided for demonstrating various available ways of embodying the present invention.

Thus, the technical features that the present invention improves the prior art are as follows:

(1) With such an arrangement that a plurality of soldering sections 52 is provided to clamp and be soldered to a circuit substrate 1, a retention section 56 is provided for fixing with an insulation body 3, and a metal shell 4 is positioned against and thus holds the bearing section 58, the present invention shows an advantage of improving the structural strength and preventing damage.

(2) With such an arrangement that an elastic pressing section 53 and a hook section 54 of a hook-up pin 5 are respectively engageable with a male connector part and a female connector part, the present invention shows an advantage of improving an effect of coupling and fixing for preventing detachment while allowing for easy disengagement.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. An electrical connection, comprising:

at least one circuit substrate;

a plurality of transmission pins, each of the transmission pins being soldered to an end of the circuit substrate;

at least one insulation body, the insulation body being fit to the circuit substrate and the transmission pins;

at least one hook-up pin, the hook-up pin being mounted on at least one lateral side of the insulation body, the hook-up pin comprising at least one pin body;

a plurality of soldering sections arranged to clamp the circuit substrate, the soldering sections being respectively formed on two sides of an end of the pin body;

at least one elastic pressing section, the elastic pressing section being formed on one end of the pin body that is adjacent to the soldering sections;

at least one hook section, the hook section being formed on an end of the elastic pressing section that is distant from the soldering sections; and at least one metal shell, the metal shell being fit over the insulation body and the hook-up pin, the hook section being selectively extendable out of the metal shell.

2. The electrical connector according to claim 1, wherein the electrical connector meets specifications of Super Mobile High-Definition Link (Super MHL).

3. The electrical connector according to claim 1, wherein the hook-up pin is integrally formed as a unitary piece.

4. The electrical connector according to claim 1, wherein the soldering sections, the elastic pressing section, or the hook section is of a curved configuration.

5. The electrical connector according to claim 1, wherein the elastic pressing section comprises at least one elastic section extending from the end of the pin body that is adjacent to the soldering sections and at least one pressing section extending from an end the elastic section that is distant from the pin body.

6. The electrical connector according to claim 1, wherein an end of the pin body that is distant from the soldering sections comprises at least one bearing section formed thereon.

7. The electrical connector according to claim 6, wherein the bearing section is attachable to at least one parts strip.

8. The electrical connector according to claim 1, wherein an end of the pin body that is distant from the soldering sections comprises at least one accommodation opening formed therein for receiving and accommodating the hook section.

9. The electrical connector according to claim 1, wherein the end of the pin body that is adjacent to the soldering sections comprises at least one constraining section formed thereon.

10. The electrical connector according to claim 1, wherein the pin body has a side edge on which at least one retention section is formed.

* * * * *